United States Patent [19]

Lapetina et al.

[11] Patent Number: 4,586,452

[45] Date of Patent: May 6, 1986

[54] UNDERWATER TOW SYSTEM AND METHOD

[75] Inventors: Robert A. Lapetina, Salt Lake City, Utah; Edward C. Brainard, II, Marion, Mass.

[73] Assignee: Edo Western Corporation, Salt Lake City, Utah

[21] Appl. No.: 614,113

[22] Filed: Jun. 28, 1984

Related U.S. Application Data

[63] Continuation of Ser. No. 288,947, Jul. 31, 1981, abandoned.

[51] Int. Cl.[4] ..... B63G 8/14

[52] U.S. Cl. ..... 114/245

[58] Field of Search ..... 114/244–247, 114/298, 108; 244/94; 367/106, 130, 177

[56] References Cited

U.S. PATENT DOCUMENTS

| | | | |
|---|---|---|---|
| 1,094,700 | 4/1914 | Bundgens | 114/247 |
| 1,823,288 | 9/1931 | Powelson et al. | 244/94 |
| 2,765,565 | 10/1956 | Mussio | 367/106 |
| 3,270,494 | 9/1966 | Holmes | 114/108 |
| 3,344,487 | 10/1967 | Doutt | 114/247 |
| 3,440,992 | 4/1969 | Chance | 114/245 |
| 3,842,770 | 10/1974 | Hedbawny et al. | 114/245 |
| 3,987,745 | 10/1976 | De Sal et al. | 367/106 |
| 4,019,455 | 4/1977 | Hungerford | 114/298 |
| 4,055,138 | 10/1977 | Klein | 114/244 |

FOREIGN PATENT DOCUMENTS

| | | | |
|---|---|---|---|
| 1045860 | 12/1958 | Fed. Rep. of Germany | 367/106 |
| 123594 | 9/1980 | Japan | 114/245 |

*Primary Examiner*—Trygve M. Blix
*Assistant Examiner*—Jesûs D. Sotelo
*Attorney, Agent, or Firm*—Thorpe, North & Western

[57] ABSTRACT

A deep water tow system adapted for being towed by a tow cable behind a ship includes a buoyant tow vehicle for housing apparatus to be used underwater, a coupler for connecting the tow vehicle to the tow cable, and a weight in the form of a multi-link chain attached to the tow cable at a location some predetermined distance from the tow vehicle. The chain is of sufficient weight to pull the tow vehicle downwardly in water until the chain contacts the water floor. When pulled by a surface vessel, the chain is pulled over the water floor and the tow vehicle is maintained some fairly constant predetermined distance above the water floor.

6 Claims, 6 Drawing Figures

UNDERWATER TOW SYSTEM AND METHOD

This application is a continuation of application Ser. No. 288,947, filed July 31, 1981, now abandoned.

BACKGROUND OF THE INVENTION

This invention relates to a system for towing a tow vehicle underwater, and more particularly to a system for maintaining the tow vehicle at a fairly stable predetermined distance above the sea floor.

The increasing demand for petroleum and petroleum products has given impetus to undersea research and exploration, with the object of such exploration being the location of petroleum deposits. Some of the principal tools in carrying out such undersea exploration are underwater sonar or acoustic seabed survey systems, combined sonar and TV systems, and the like. Such systems are used for obtaining information relating to horizontal seabed topography and sub-bottom structure or bathymetric profile as well as actual pictures of the sea floor. This information is useful, not only in assisting in the location of offshore oil deposits, but also in providing a better understanding of the oceans generally, their resources, and the geology of the earth. The closer to the sea floor the system can be placed, the more accurate and detailed is the information obtained.

Information about seabed topography and sub-bottom structure is typically gathered by towing behind a ship a so-called tow vehicle containing sonar transducers and other instruments. The transducers transmit sonar or acoustical signals toward the sea floor and receive reflections from the floor and from sub-floor layers. This information is then transmitted to recording devices on the ship where records of the information, for example in the form of line traces on chart paper, are made. In gathering such information, it is important that the tow vehicle be maintained at a fairly constant elevation close to the sea floor and that the yaw, heave and roll of the tow vehicle be minimized. This becomes especially difficult as the depth of the water increases since maintenance of the stability of the tow vehicle is carried out, to the extent possible, by controlling the speed of the ship and by operation of the winch (letting out or reeling in the cable). As cable length increases, such control becomes very difficult. In particular, the tow vehicle sinks in the water under its own weight and the weight of the cable, and then the depth of the vehicle is controlled by controlling the speed of the ship and the tow cable winch. If the cable length were very great, which would be the case of deep water operation, there would be a significant delay time between discovering that the tow vehicle should be raised (for example because an obstacle is being approached) or lowered (for example because a valley is being approached), and the actual raising or lowering of the tow body by increasing the ship speed (or reeling in the cable) or reducing the ship speed (or paying out the cable) respectively. Also, if the cable length is very great, very small speed changes in the ship cause the tow vehicle to change depth significantly thereby making it difficult (and risky to the tow vehicle) to maintain a stable elevation of the tow vehicle above the sea floor.

Because the tow vehicle is connected directly via the tow cable to the ship, erratic moves of the ship or cable are transmitted directly to the tow vehicle, possibly causing it to yaw, heave or roll. Also, since controlling the ships speed through the water is the method of maintaining the tow vehicle above the sea floor, any sudden stops of the ship may result in the tow vehicle "crashing" into the sea floor.

SUMMARY OF THE INVENTION

It is an object of the invention to provide a new and improved underwater tow system by which a tow vehicle may be towed by a ship.

It is another object of the invention to provide an underwater tow system whereby a tow vehicle may be towed at a fairly constant predetermined elevation above the sea floor.

It is a further object of the invention to provide an underwater tow system which maintains the stability of a tow vehicle and reduces the yaw, heave and roll.

It is still another object of the invention to provide an underwater tow system which serves to reduce the effects of erratic movements of the ship on the tow vehicle.

It is an additional object of the invention to provide an underwater tow system in which stoppage of the towing ship will not cause the tow vehicle to drop to the sea floor.

It is also an object of the invention to provide an underwater tow system which may be operated substantially unattended over a wide range of speeds.

It is another object of the invention to provide an underwater tow system which includes a buoyant tow vehicle capable of floating to the surface of the water in the event the vehicle is detached from the tow cable.

The above and other objects of the invention are realized in a specific illustrative embodiment of an underwater tow system which includes a buoyant tow vehicle for housing apparatus to be used underwater, apparatus for coupling the tow vehicle to a tow cable, and a weight member attached to the coupling apparatus or the tow cable. The weight member has a sufficient weight to pull the tow vehicle downwardly in water until the weight member contacts the sea floor. With this configuration, a fairly constant predetermined elevation of the tow vehicle above the sea floor can be maintained by appropriate selection of the distance between the tow vehicle and the point of attachment of the weight member to the coupling means or tow cable, and by maintaining a fairly constant speed of the ship through the water. Attachment of the weight member to the coupling apparatus or tow cable also serves to isolate the tow vehicle from the effects of erratic movements of the ship or forward portion of the tow cable. Of course, any sudden stops by the ship would not cause the tow vehicle to drop to the sea floor since the tow vehicle is buoyant.

In accordance with one aspect of the invention, the coupling apparatus includes a shear element which will release in the event a certain pulling force is applied to the tow vehicle. The tow vehicle also includes a signal producing device so that in the event the sheer element releases and the tow vehicle floats to the surface, the tow vehicle will produce signals to indicate its location so that it can be retrieved.

One especially advantageous method of using the tow system involves paying out a substantial length of tow cable so that some of the cable, as well as the weight member, drag along the sea floor. This relieves the ship's tow cable winch operator from carefully attending the winch in an attempt to maintain only the weight member in contact with the sea floor.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
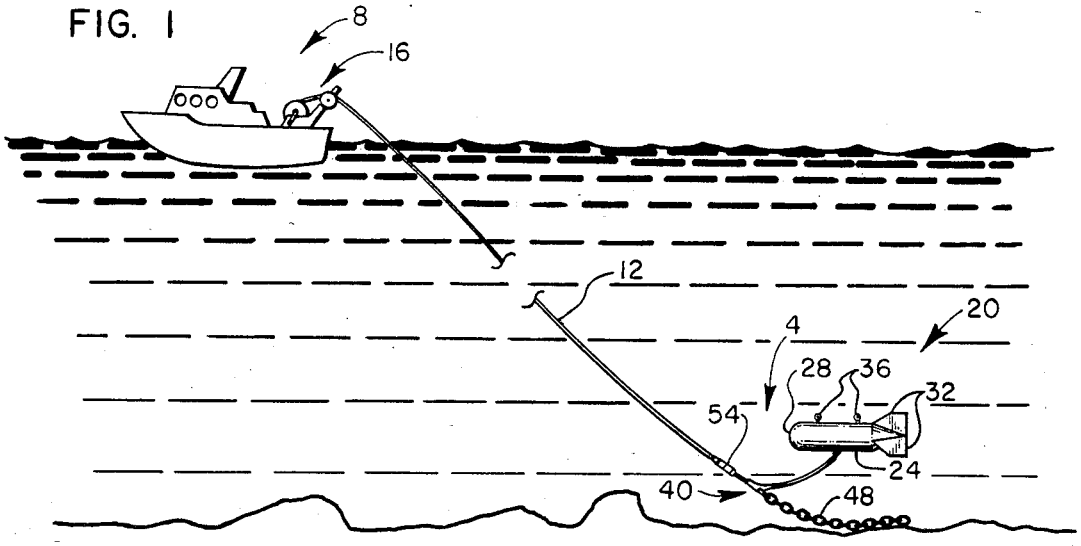
FIG. 1 is a side view of an underwater tow system made in accordance with the present invention, showing the system as it could be utilized underwater.

Referring to FIG. 1, there is shown an underwater tow system 4 made in accordance with the present invention and being towed by a surface vessel 8. The tow system 4 is coupled by way of a tow cable 12 to a winch 16 on the vessel. The tow cable 12 includes, in a conventional manner, electrical conductors for connecting electrical apparatus on board the ship 8 with underwater apparatus housed in a tow vehicle 20 of the underwater tow system.

The underwater tow system 4 includes the tow vehicle 20 (see FIGS. 1 and 2) formed generally in the shape of a torpedo and having an elongate cylindrical body 24 rounded on a front end 28 thereof. The rear of the body 24 tapers inwardly to accommodate three fins 32 circumferentially spaced about the body. The streamlined shape of the tow body 24, together with the fins 32, serve to stabilize movement of the tow vehicle through the water.

Eyelets 36 are attached to the top of the body 24 at spaced apart locations to provide coupling or lifting elements by which the tow vehicle 20 may be lifted from the water.

Figure 2:
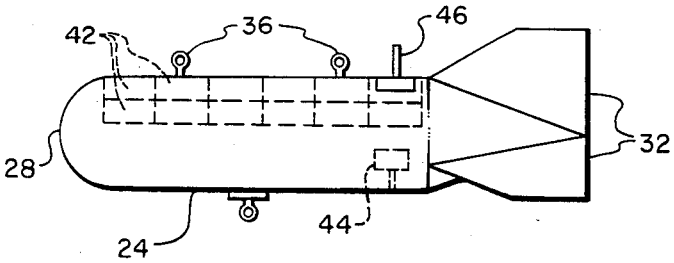
FIG. 2 is a side elevation view of the tow vehicle of FIG. 1 showing the positioning of some of the components in the vehicle.

Illustrative parameters of the tow vehicle 20 are a body length of about 17 feet, a body diameter of 3 feet, and a weight of 1500 pounds in air (when component electrical apparatus is included). The tow body 20 is constructed to be buoyant in water, with a net buoyant force of about 250 pounds. Buoyancy is achieved by including within the tow body 24 a plurality of syntactic foam cylinders, balls or blocks 42 positioned against the upper wall of the body as shown in FIG. 2, and held in place, for example, by epoxy. Of course, other buoyant material might also be utilized provided such material did not interfere with operation of electrical equipment contained in the tow vehicle. Syntactic foam has been found to be suitable since it does not resonate to thereby create interference with acoustical equipment which might be utilized on the tow vehicle.

Also included in the tow vehicle is a conventional pinger 44 which is arranged to automatically commence transmitting an acoustical signal when power to the pinger is interrupted. This would occur if, for example, the tow vehicle were detached from the tow cable. A light beacon 46 is positioned on top of the tow vehicle to emit light if the tow vehicle floats to the surface. That is, the light beacon is attached to emit light when the water pressure falls below some level indicating that the vehicle is nearing the surface.

A fairlead assembly 40 interconnects the tow cable 12 with the tow vehicle 20 and with a chain weight 48. The chain weight 48 includes a plurality of links, an end one of which is coupled to the fairlead assembly 40. The chain weight is provided to pull the tow vehicle 20 and tow cable 12 downwardly in the water until the chain contacts the sea floor. As the ship 8 moves in the water, the chain weight 48 will drag over the sea floor and, since the tow vehicle 20 is buoyant, the tow vehicle will "fly" or move through the water at a substantially constant predetermined distance above the sea floor. This distance depends upon the towing speed and the length of the cable or coupling between the fairlead assembly 40 and the tow vehicle 20. For a tow vehicle having a buoyant force of about 250 pounds, a weight for the chain 48 advantageously is about 2000 pounds. This weight, it has been found, is sufficient to dampen small erratic movements by the tow cable 12 caused either by sea currents or by small speed surges of the vessel 8. Because of this dampening effect, the tow vehicle 20 remains more stable as it is pulled through the water. That is, the yaw, heave and roll which might otherwise occur in the tow vehicle 20 by reason of erratic movements of the tow cable 12 are reduced. Also, in the event that the ship 8 comes to a halt, the tow vehicle 20, being buoyant, will continue to float above the sea floor and not "crash" into the floor or other sea floor obstacle.

Although other types of weighting devices could be used, it has been found that the use of a chain 48 is advantageous since the total weight can be readily modified by simply removing or adding links. Also, slight variations in the speed of the ship will generally result simply in a few more (or less) chain links contacting the sea floor to still maintain the elevation of the tow vehicle 20 at a substantially constant height above the sea floor. Thus there is not a single speed threshold level at which the weight is lifted from the sea floor as might be the case with a single unitary weight.

Figure 3:
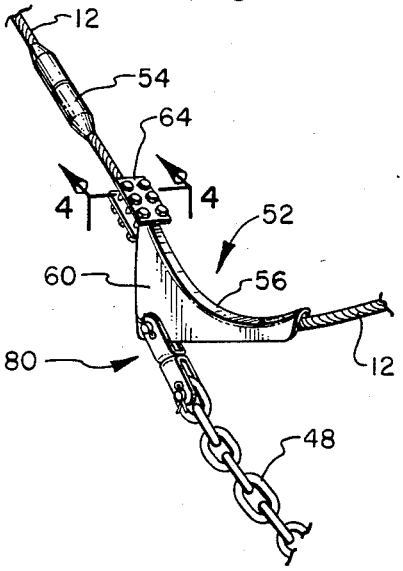
FIG. 3 is a fragmented, perspective view of the fairlead assembly of the underwater tow system of FIG. 1.

FIG. 3 shows a more detailed perspective view of the fairlead assembly 40 of FIG. 1. This assembly is swiveably coupled by an electro-mechanical coupler 54 to the cable 12. The coupler 54 is of conventional design. The assembly 40 includes a saddle 52 composed of a curved channel 56 into which the cable 12 is inserted, and a pair of skirts 60 which extend downwardly on either side of the cable 12 as shown. An elongate upper extension of the channel 56 and skirts 60 is placed in a clamp 64 for clamping the fairlead assembly onto the cable 12. The cable 12 thus runs through the channel 56, between the skirts 60, and generally curves with the curvature of the channel.

Figure 4:
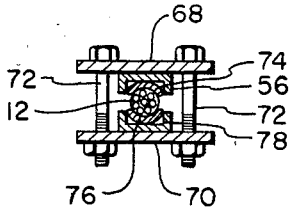
FIG. 4 is a cross-sectional view of the clamp of FIG. 3 taken along lines 4—4.

The clamp is shown in greater detail in FIG. 4, which is a cross sectional view thereof along lines 4—4 of FIG. 3. As shown in FIG. 4, the clamp includes a top plate 68 and a bottom plate 70 held in a clamping relationship by bolts 72. The channel 56 of the fairlead assembly 52 which is held between the clamp includes a friction pad 74. A channel element 78 is welded to the plate 70 and includes therein a similar friction pad 76. These pads are shaped to fit snuggly about the tow cable 12 to hold the tow cable in place when the clamp is tightened. Advantageously, the friction pads 74 and 76 are made of lead to deform against the cable as the clamp is tightened.

The pads are held in place in the channel 56 and the channel element 78 by pressure. The side walls of the two channels 56 and 78 will mate to prevent damage to the cable 12 in the event the bolts 72 are tightened too tight.

Figure 5:
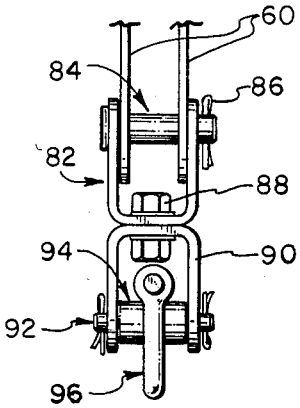
FIG. 5 is a front view of the coupling apparatus for coupling the chain of FIG. 3 to the fairlead assembly.

Referring again to FIG. 3 and also to FIG. 5, it will be seen that the fairlead assembly 52 also includes a coupling mechanism 80 interconnecting the skirts 60 to the chain weight 48. The coupling mechanism 80 includes a first clevis 82, the free ends of which extends about the skirts 60 to align openings in the ends of the clevis with openings in the skirt 60 through which a clevis pin 84 is inserted. A cotter pin 86 then secures the clevis pin 84 in place to thereby secure the clevis 82 on the skirts 60.

The base of the clevis 82 is swivelably attached by way of a bolt 88 to the base of a second clevis 90, as best seen in FIG. 5. A shear pin 92 extends through aligned openings in the free ends of the clevis 90 and through a sleeve 94. A shackle 96 is fitted in place about the sleeve 94 and this shackle is then linked with the end link of the chain weight 48 to secure the chain weight onto the fairlead assembly. The shear pin 92 is selected so as to break and release the shackle 96 from the clevis 90 when the shackle is subjected to some predetermined pulling force. Thus, if the chain gets caught on the sea bottom, the shear pin 92 will release the chain to thus avoid possible damage to the fairlead assembly which might otherwise occur if the chain weight 48 were allowed to continue pulling on the assembly. The breaking strength of the shear pin 92 must, of course, be greater than the weight of the chain 48 so that while being launched in the water, the chain doesn't cause the shear pin to break. For a chain weight of about 2000 pounds, the breaking strength of the shear pin 92 might illustratively be 4000 pounds.

Figure 6:
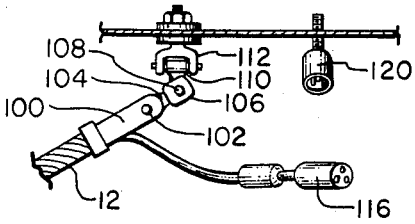
FIG. 6 is a side view of the coupling apparatus for coupling the tow cable to the tow vehicle.

FIG. 6 shows a side view of a connector mechanism by which the tow cable 12 is coupled to the underneath side of the body 24 of the tow vehicle 20. This connecting apparatus includes a gripping element 100 suitable for connection to the end of the tow cable 12. An exemplary gripping element might be the element known as Dyna-Grip produced by Preformed Line Products, Inc. of Cleveland, Ohio. The end of the gripping element 100, opposite the end at which the element is connected to the tow cable 12, is formed into a clevis and includes a clevis pin 102 which is inserted in aligned openings in the ends of the clevis to extend through the opening in a tongue 104 inserted in the clevis. The tongue 104 is attached to a yoke 106 which includes aligned openings through which a shear pin 108 extends. The shear pin 108 also extends through another coupling element 110 which extends within a yoke 112 which is coupled to the underneath side of the body 24 of the tow vehicle. The shear pin 108 has an illustratively breaking strength of about 10,000 pounds so that if the tow vehicle gets caught on some type of underwater obstruction, the pin will break and release the tow vehicle to allow it to float to the surface and be recovered. Upon release by the shear pin 108, electrical connectors 116 and 120 (such as the ER type waterproof connectors produced by Boston Insulated Wire Co.) are pulled apart interrupting electrical power to the pinger 44 and this causes the pinger (FIG. 2) to emit acoustical signals which may be detected on the towing ship to indicate the location of the tow vehicle. In addition, the beacon light 46 begins emitting light signals as the vehicle reaches the water surface. The positioning of the buoyant material 42 maintains the tow vehicle 20 upright on the surface so that the beacon light 46 remains out of water. The connection between the tow vehicle and the cable 12 allows pivoting in two degrees.

In use, it may be advantageous simply to pay out a sufficient amount of tow cable 12 so that while towing the tow vehicle, a portion of the cable itself drags over the sea floor. Allowing a portion of the tow cable 12 to drag on the sea floor, as well as the chain weight 48, serves to further isolate the effects of erratic movement of the ship 8 from the tow vehicle 20 and to alleviate the ship winch operator from trying to maintain only the chain weight 48 in contact with the sea floor.

It should be understood that the above-described arrangements are only illustrative of the principles of the present invention and that numerous modifications thereof could be devised by those skilled in the art without departing from the spirit and scope of the invention. For examle, weights other than the chain 48 might be utilized to pull the tow vehicle 20 to the sea floor. Also, a variety of mechanisms could be employed to join the tow cable, weight and tow vehicle. The appended claims are intended to cover all such alternative embodiments and arrangements.

What is claimed is:

1. An underwater tow system adapted for being towed by a tow cable behind a vessel, said system including a tow vehicle for housing apparatus for use underwater, said tow vehicle having positive buoyancy in water, means for coupling the tow vehicle to the tow cable to allow the tow vehicle to float upwardly from the cable, weight means attached to the tow cable at a predetermined distance from the tow cable, said weight means having a weight sufficient to pull the tow cable and tow vehicle downwardly in water until the weight means contacts the water floor, and a fairlead assembly for connecting the weight means to the tow cable, said fairlead assembly comprising saddle means for fitting over the cable, said saddle means including a pair of skirts extending downwardly on each side of the cable, a clamp for clamping the saddle means to the cable, and means for attaching the weight means to the skirts of the saddle means.

2. An underwater tow system as in claim 1 wherein said attaching means includes means for swivelably attaching the weight means to the skirts of the saddle means.

3. An underwater tow system as in claim 1 wherein said attaching means includes a shear element for releasing the weight means from attachment to the skirts of the saddle means when subjected to a certain pulling force on the weight means.

4. An underwater tow system as in claim 1 wherein said clamp includes a friction pad made of lead for contacting the cable.

5. A tow system for towing objects underwater by tow cable behind a vessel, said system including a buoyant tow vehicle, means coupling the tow vehicle to an end of the cable, said coupling means including a cable length, one end of which is coupled to the tow vehicle, and the other end of which is swivelably coupled to the tow cable, weight means attached to the cable length at a location spaced some distance from the tow vehicle for pulling the two cable downwardly in the water until the weight means contacts the water floor, and a fair lead assembly for connecting the weight means to the cable length, said fair lead assembly comprising a saddle for fitting over the cable length, said saddle having a curved channel into which the cable length is fitted and a pair of skirts extending from the channel on either side of the cable in a generally parallel relationship, a clamp for clamping the saddle to the cable length, and means for connecting the weight means to the skirts.

6. A tow system as in claim 5 wherein said connecting means includes a shear element for releasing the weight means from attachment to the skirts when subjected to a certain pulling force on the weight means.

* * * * *